US005814757A

United States Patent [19]

Buss

[11] Patent Number: 5,814,757

[45] Date of Patent: Sep. 29, 1998

[54] MUZZLE BRAKE

[76] Inventor: Richard A. Buss, 1055 E. Washington, Cottage Grove, Oreg. 97424

[21] Appl. No.: 732,160

[22] Filed: Oct. 16, 1996

Related U.S. Application Data

[63] Continuation-in-part of Ser. No. 680,143, Jul. 15, 1996, abandoned.

[51] Int. Cl.[6] ..... F41A 21/00

[52] U.S. Cl. ..... 89/14.3

[58] Field of Search ..... 89/14.3, 14.2

[56] References Cited

U.S. PATENT DOCUMENTS

| | | | |
|---|---|---|---|
| Re. 35,381 | 11/1996 | Rose | 89/14.3 |
| 2,503,491 | 4/1950 | Janz | 181/41 |
| 2,662,326 | 12/1953 | Powell | 42/79 |
| 2,712,193 | 7/1955 | Mathis | 42/79 |
| 3,367,055 | 2/1968 | Powell | 42/79 |
| 4,510,843 | 4/1985 | Rabatin | 89/14.4 |
| 4,869,151 | 9/1989 | Chahin | 89/14.3 |
| 5,136,923 | 8/1992 | Walsh, Jr. | 89/14.2 |
| 5,279,200 | 1/1994 | Rose | 89/14.3 |
| 5,357,842 | 10/1994 | Reynolds | 89/14.3 |
| 5,367,940 | 11/1994 | Taylor | 89/14.3 |
| 5,425,298 | 6/1995 | Coburn | 89/14.3 |
| 5,463,930 | 11/1995 | Bisping et al. | 89/29 |
| 5,509,345 | 4/1996 | Cyktich | 89/14.05 |

*Primary Examiner*—J. Woodrow Elored
*Attorney, Agent, or Firm*—Dellett and Walters

[57] ABSTRACT

A muzzle brake comprises a hollow inner sheath including forward, central and rear regions, the rear region adapted for attachment to a firearm and the central region including forwardly inclined apertures therein. The muzzle brake further comprises a hollow outer sheath including forward, central and rear regions, the forward and rear regions, respectively, of the outer sheath being adapted for attachment to the forward and rear regions of the inner sheath. The central region of the outer sheath includes forwardly inclined apertures therein and is spaced from the central region of the inner sheath so as to define a chamber therebetween. The apertures in the outer sheath preferably are staggered and misaligned with respect to the apertures of the inner sheath such that the apertures and chamber redirect the direction of sound waves and discharge gases exiting from the firearm so that the sound waves and discharge gases are redirected so as to move toward a target and away from a shooter.

33 Claims, 3 Drawing Sheets

MUZZLE BRAKE

RELATED CROSS REFERENCES

This application is a continuation-in-part of U.S. patent application Ser. No. 08/680,143 filed Jul. 15, 1996 now abandoned.

The present invention pertains to an improved muzzle brake, and more particularly, to a firearm noise redirection system that redirects noise created from discharge of a firearm, toward a target and away from the firearm shooter.

BACKGROUND OF THE INVENTION

A bullet leaving a firearm typically creates sound waves and discharge gases that trail rearwardly from the bullet. Such sound waves and discharge gases may cause injury to the shooter's ears. A typical noise and recoil suppressor apparatus includes an inner and an outer sheath having a plurality of apertures in the inner sheath and the outer sheath. The sheaths are typically positioned directly abutting one another along their lengths so that each aperture in the inner sheath is directly aligned with a corresponding aperture in the outer sheath. The apertures in the inner and outer sheaths preferably are positioned perpendicularly to an elongate axis of the noise and recoil suppressor such that sound waves and firearm discharge gases are expelled perpendicularly outwardly from the bullet's line of fire.

As the sound waves and discharge gases move through the apertures aligned generally perpendicularly to the path of the bullet, some of the sound waves continue to move rearwardly toward the shooter. Such continued rear movement is possible because such prior art systems do not require the sound waves and discharge gases to move through staggered and misaligned apertures and thereby do not effectively redirect the travel path of such sound waves and discharge gases.

SUMMARY OF THE INVENTION

An object of the present invention is to provide, therefore, an improved muzzle brake that redirects the travel path of sound waves and discharge gases of a firearm toward a target and away from a shooter.

Another object of the present invention is to provide an improved muzzle brake that hinders rearward movement of sound waves and discharge gases created by discharge of a firearm.

Yet another object of the present invention is to provide an improved muzzle brake having an inner sheath and an outer sheath that are attached to each other, respectively, at forward and rear regions.

A further object of the present invention is to provide an improved muzzle brake having an inner sheath and an outer sheath that define a chamber therebetween so as to redirect sound waves and discharge gases created by discharge of a firearm.

Still another object of the present invention is to provide an improved muzzle brake that may be easily fastened to the barrel of an existing firearm.

Yet another object of the present invention is to provide an improved muzzle brake having forwardly inclined apertures so as to effectively redirect sound waves and discharge gases created by discharge of a firearm.

Still a further object of the present invention is to provide an improved muzzle brake that provides a gas travel path from the inner sheath to the outer sheath at an angle and with an angular velocity component that forces sound waves and discharge gases from the firearm to move toward the target and away from the shooter.

Accordingly, the present invention comprises an improved muzzle brake including a hollow inner sheath having forward, central and rear regions. The rear region of the inner sheath is adapted for attachment to the muzzle end portion of a firearm and the central region of the inner sheath includes forwardly inclined apertures so as to provide a gas travel path from a hollow inner bore of the inner sheath to an outer surface thereof at an angle and with an angular velocity component which forces sound waves and discharge gases exiting the firearm to move away from the shooter and toward the target. The muzzle brake further includes a hollow outer sheath having forward, central and rear regions, the forward and rear regions, respectively, of the outer sheath being adapted for attachment to the forward and rear regions of the inner sheath. The central region of the outer sheath includes therein forwardly inclined apertures which provide a gas travel path from an inner bore of the outer sheath to an outer surface thereof at an angle and with an angular velocity component which forces sound waves and discharge gases exiting the firearm to move away from the shooter and toward the target. The central region of the outer sheath is spaced a distance from the central region of the inner sheath so as to define a chamber therebetween such that sound waves and discharge gases exiting the firearm pass through the apertures in the inner sheath, through the chamber, and thereafter through the apertures in the outer sheath thereby being effectively redirected toward the target.

In the preferred embodiment, the forward and rear portions of the outer surface of the inner sheath are threadably attached to the forward and rear portions of the inner surface of the outer sheath such that in the attached position the outer sheath is firmly attached to the inner sheath. The inner sheath further comprises threads on an inner surface of the hollow bore so as to threadably engage the muzzle end portion of a firearm. Accordingly, the outer sheath is releasably secured to the inner sheath to form the muzzle brake and the muzzle brake is releasably secured to the firearm.

In the preferred embodiment, the apertures in the inner sheath are arranged in circumferentially staggered rows and are forwardly inclined at an angle of between 5° and 20° from a position generally perpendicular to an elongate axis of the inner sheath. Similarly, the apertures in the outer sheath are arranged in circumferentially staggered rows and are forwardly inclined at an angle of between 5° and 20° from a position generally perpendicular to an elongate axis of the outer sheath. In a preferred embodiment, the apertures in the inner and outer sheaths are inclined at an angle of 11° and are staggered and misaligned with respect to each other.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
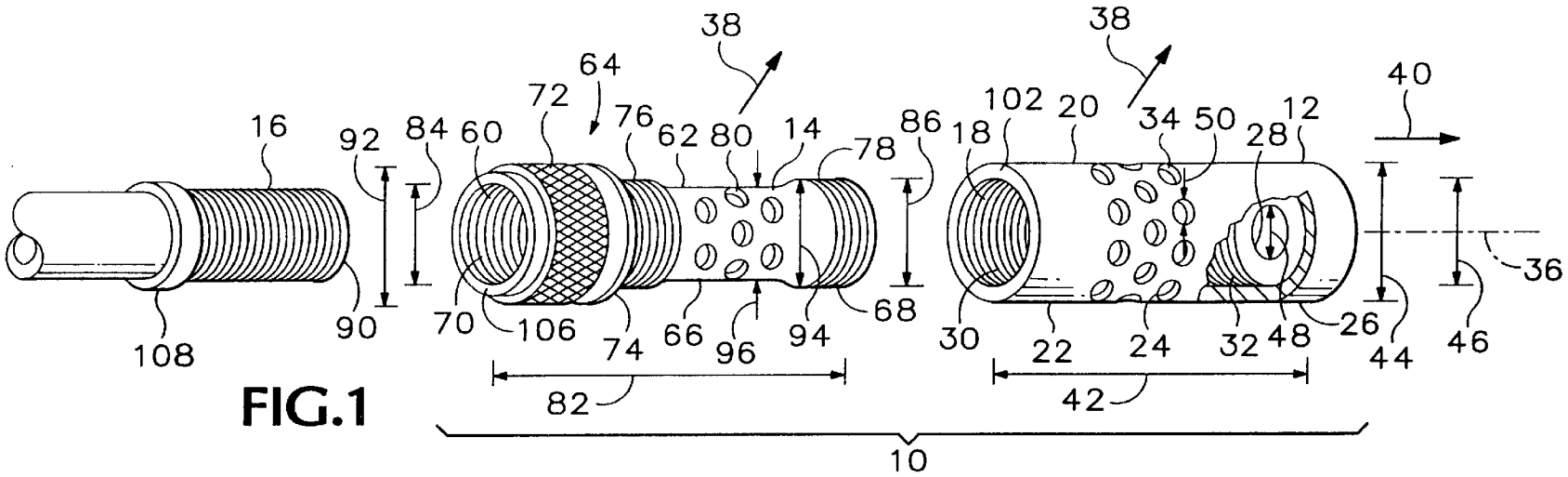
FIG. 1 is an exploded side and rear isometric view of an improved muzzle brake according to the present invention positioned adjacent the muzzle end of a firearm.

Referring to FIG. 1, which is an exploded side and rear isometric view of an improved muzzle brake according to the present invention positioned adjacent the muzzle end of a firearm, a muzzle brake 10 comprises an outer sheath 12, adapted for mounting on an inner sheath 14, which is suitably arranged for mounting on the muzzle end portion 16 of a firearm. In the preferred embodiment, outer sheath 12 is a hollow cylinder having an inner bore 18 and an outer surface 20. Outer sheath 12 further comprises a rear region 22, a central region 24 and a forward region 26. Forward region 26 includes an aperture 28 for discharge of a bullet from firearm 16 through muzzle brake 10. Inner bore 18 of outer sheath 12 includes attachment means 30 at rear region 22 and attachment means 32 at forward region 26. In the preferred embodiment, attachment means 30 and 32 are helical grooves, such as threads. In other embodiments, attachment means 30 and 32 may be snap fasteners, weld joints or screw-type fasteners.

Central region 24 of outer sheath 12 preferably comprises a plurality of apertures 34 that communicate between inner bore 18 and outer surface 20 of outer sheath 12. Apertures 34 preferably are arranged in circumferentially staggered rows around an axis 36 of muzzle brake 10. Preferably, apertures 34 are forwardly inclined toward forward region 26 such that sound waves and discharge gases 38 exiting apertures 34 tend to move in a direction 40 toward the forward region of the outer sheath. Preferably, apertures 34 are arranged in three staggered rows, each row including 12 apertures such that outer sheath 12 includes a total of thirty-six circumferentially arranged apertures.

Outer sheath 12 may be manufactured of stainless steel or any corrosion-resistant material and preferably is manufactured of the same material as the muzzle end 16 of the firearm. Outer sheath 12 preferably has a length 42 of approximately 5 cm, an outer diameter 44 of approximately 2.1 cm and an inner diameter 46 of approximately 1.6 cm. Forward region aperture 28 preferably has a diameter 48 of approximately 0.8 cm (although this will vary with the caliber of the firearm), and central region apertures 34 preferably have a diameter 50 of approximately 0.4 cm.

Still referring to FIG. 1, inner sheath 14 comprises an inner bore 60 and an outer surface 62. The inner sheath further comprises a rear region 64, a central region 66 and a forward region 68. Inner bore 60 of rear region 64 preferably includes fastening means 70 for attachment to the muzzle end portion 16 of a firearm. In the preferred embodiment, attachment means 70 may comprise helical grooves, such as threads. Attachment means 70 may also comprise snap-type fasteners, weld joints or screw-type fasteners. Outer surface 62 of rear region 64 includes grasping means 72, such as knurled regions, so as to facilitate releasably securing inner sheath 14 to muzzle end portion 16 of a firearm. Outer surface 62 of inner sheath 14 further comprises a shoulder 74 in rear region 64, attachment means 76 positioned adjacent shoulder 74, and attachment means 78 in forward region 68. In the preferred embodiment, attachment means 76 and 78 are adapted to engage, respectively, attachment means 30 and 32 of outer sheath 12.

Central region 66 of inner sheath 14 includes a plurality of apertures 80 that communicate between inner bore 60 and outer surface 62 of inner sheath 14. In the preferred embodiment, apertures 80 are arranged in circumferentially staggered rows around axis 36 of muzzle brake 10. Preferably, apertures 80 are arranged in three staggered rows, each row including six apertures such that inner sheath 14 includes a total of eighteen circumferentially arranged apertures. Apertures 80 preferably are forwardly inclined such that sound waves and discharge gases 38 traveling from inner bore 60 through apertures 80 are directed forwardly toward forward region 68 of inner sheath 14.

Inner sheath 14 may be manufactured of stainless steel or any corrosion-resistant material and preferably is manufactured of the same material as the muzzle end 16 of the firearm. Inner sheath 14 preferably has a length 82 of approximately 5.5 cm, an inner diameter 84 of bore 60 in rear region 64 of approximately 1.4 cm, and an inner diameter 86 of bore 60 in central and forward regions 66 and 68 of approximately 1.2 cm. Accordingly, bore 60 includes an internal shoulder 88 (FIG. 2) which abuts an end 90 of firearm 16 when muzzle brake 10 is secured on the firearm. Inner sheath 14 further comprises an outer diameter 92 at grasping means 72 and shoulder 74 of approximately 2.2 cm, an outer diameter 94 at attachment means 76 and 78 of approximately 1.6 cm and an outer diameter 96 at central region 66 of approximately 1.3 cm.

Figure 2:
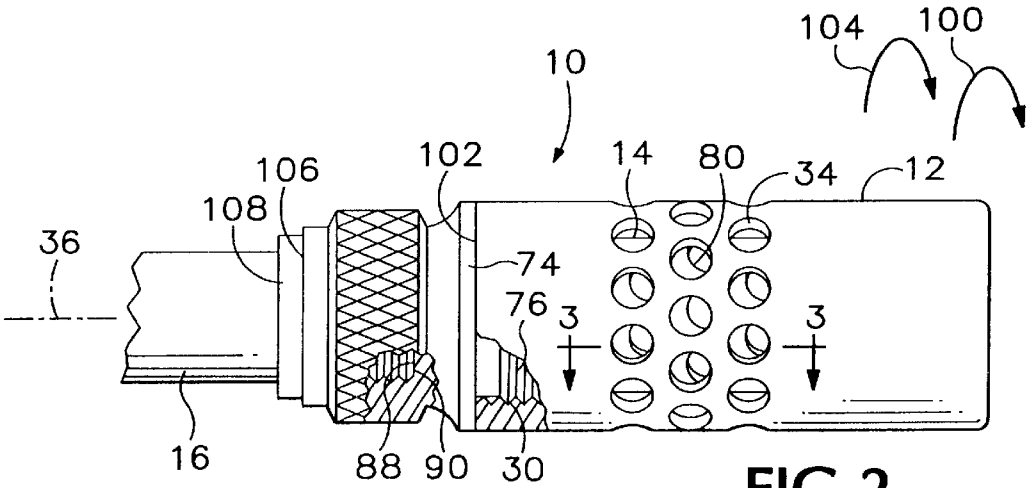
FIG. 2 is a partial sectional side elevational view of the muzzle brake of FIG. 1 mounted on the muzzle end of a firearm.

Referring now to FIG. 2, which is a partial sectional, side elevational view of the muzzle brake of FIG. 1 mounted on the muzzle end of a firearm, outer sheath 12 is mounted on inner sheath 14 which is in turn mounted on the muzzle end 16 of a firearm. To mount outer sheath 12 on inner sheath 14, outer sheath 12 is rotated in direction 100 such that outer sheath 12 is threadably engaged with inner sheath 14 and apertures 34 and 80 are staggered and misaligned with respect to each other. Specifically, attachment means 30 and 32 are connected, respectively, to attachment means 76 and 78. In this position, an end surface 102 of outer sheath 12 abuts shoulder 74 of inner sheath 14.

To mount muzzle brake 10 to the firearm, inner sheath 14, with outer sheath 12 secured thereto, is rotated in direction 104 such that the inner sheath threadably engages muzzle end 16 of the firearm. In this position, an end surface 106 of inner sheath 14 abuts a shoulder 108 on firearm 16 and internal shoulder 88 abuts end 90 of the firearm such that the muzzle brake is securely mounted in place. In another embodiment, as discussed hereinbelow in conjunction with FIG. 4, internal shoulder 88 of rear region 64 of inner sheath 14 may not abut end surface 90 of firearm 16 when muzzle brake 10 is mounted thereon. In both embodiments, however, apertures 34 in outer sheath 12 are staggered and misaligned with respect to apertures 80 in inner sheath 14. For the ease of illustration, apertures 34 and 80 in FIG. 2 are shown as positioned perpendicular to axis 36 and not forwardly inclined.

Figure 3:
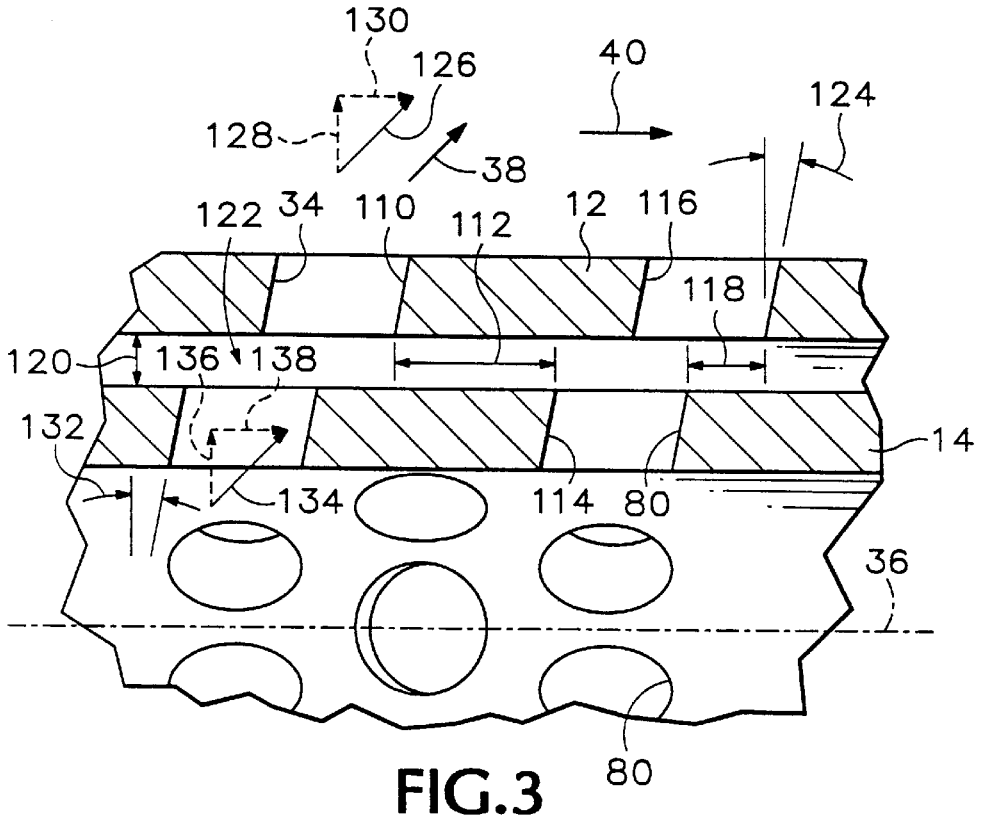
FIG. 3 is a partial cross-sectional view taken along line 3—3 of FIG. 2 showing apertures in the inner and outer sheaths of the muzzle brake.

Referring now to FIG. 3, which is a partial cross-sectional view taken along line 3—3 of FIG. 2 showing apertures in the inner and outer sheaths of the muzzle brake, apertures 34 in outer sheath 12 are shown staggered with respect to apertures 80 in inner sheath 14. Specifically, an aperture 110 in outer sheath 12 is spaced a distance 112 along axis 36 from an aperture 114 in inner sheath 14. Similarly, an aperture 116 in outer sheath 12 is spaced a distance 118 along axis 36 from aperture 114 in inner sheath 14. Moreover, outer sheath 12 and inner sheath 14 are spaced apart by a distance 120 which is perpendicular to axis 36, the spaced distance 120 extending along the central regions of the inner and outer sheaths so as to define a chamber 122 therebetween. In a preferred embodiment, distance 112 is 0.3 cm, distance 118 is 0.3 cm, and distance 120 is 0.6 cm.

In the preferred embodiment, apertures 34 in outer sheath 12 are forwardly inclined such that sound waves and discharge gases 38 exiting the muzzle end 16 of the firearm are redirected forwardly in direction 40 toward a target and away from the shooter. Typically, apertures 34 are forwardly inclined at an angle 124 between 5° and 20° from a position perpendicular to axis 36. In the preferred embodiment, angle 124 is approximately 11°. Angling of apertures 34 provides a gas travel path 126 having a vertical component 128 and a horizontal component 130. In particular, an angle 124 of 11° is believed to provide a maximum horizontal component 130 such that sound waves and discharge gases 38 are effectively redirected toward a target and away from the shooter.

Similarly, apertures 80 in inner sheath 14 are preferably inclined at an angle 132 of between 5° and 20°, and more preferably at an angle of 11° from a position perpendicular to axis 36. Accordingly, sound waves and discharge gases 38 move along a travel path 134 having a perpendicular component 136 and a horizontal component 138 that is maximized by angle 132 of 11°. Sound waves and discharge gases 38 exiting muzzle end 16 of the firearm, therefore, travel through inner bore 60 of inner sheath 14, through apertures 80 in inner sheath 14, through chamber 122, and thereafter through apertures 34 in outer sheath 12.

Movement of the sound waves and discharge gases through apertures 80 redirects the sound waves and discharge gases to maximize the horizontal component 138 of travel path 134 such that the sound waves and discharge gases are forwardly redirected into and within chamber 122. Movement of the sound waves and discharge gases through intermediate chamber 122, caused by the staggered and misaligned relationship between apertures 34 and 80, is believed to create eddies further facilitating redirection of the sound waves and discharge gases by the muzzle brake. Thereafter, the sound waves and discharge gases travel through apertures 34 in outer sheath 12 so as to further redirect the gases thereby maximizing the horizontal component 130 of the travel path 126 of the sound waves and discharge gases.

Figure 4:
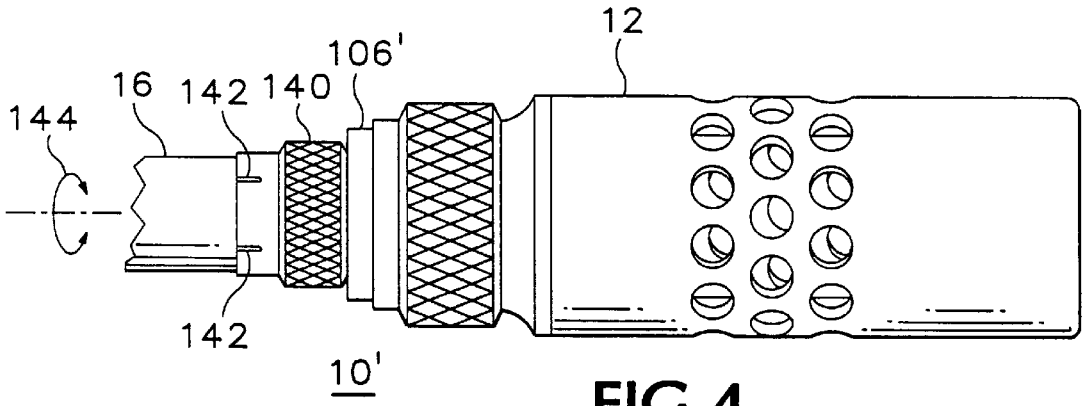
FIG. 4 is an illustration of an adjustment element for fine tuning the muzzle brake.

Referring now to FIG. 4, an alternative embodiment of the muzzle brake will be described. In the embodiment of FIG. 4, muzzle brake 10' further includes an annular adjustment element 140 which is threadably mounted to the end of the rifle barrel 16. Indexing marks 142 are regularly spaced about the circumference of one end of the adjustment element, suitably between four and ten such marks being employed. Adjustment element 140 is adapted to be rotated about the longitudinal axis of the barrel as illustrated by arc 144, and is threadably engaged such that rotary motion of the element allows adjustment of the position of the element along an extent of the barrel.

In use, muzzle brake 10' is attached to the barrel and adjustment element 140 is rotated until it is firmly seated against end surface 106' of the muzzle brake body. The rifle is then test fired, and the accuracy is observed. Next, the adjustment element is loosened and muzzle brake 10' is either moved inwardly or outwardly along the rifle barrel to a small extent, whereupon the adjustment element is then rotated to firmly seat against the muzzle. The rifle is again test fired. These operations are iteratively continued, until the desired firing accuracy is obtained. The indexing marks 142 aid in the adjustment process by allowing definite variations in position to be accomplished.

Accordingly, it will be understood that the position of the muzzle brake may be adjusted inwardly and outwardly along the barrel, enabling fine tuning of the position thereof. Since the rifle barrel is subject to vibration and other motions during firing, such fine tuning is advantageous, as it allows adjustment of the position of the tip of the barrel in its vibration profile as the bullet leaves the end of the barrel, enabling adjustment of the firing accuracy of the rifle.

Figure 5:
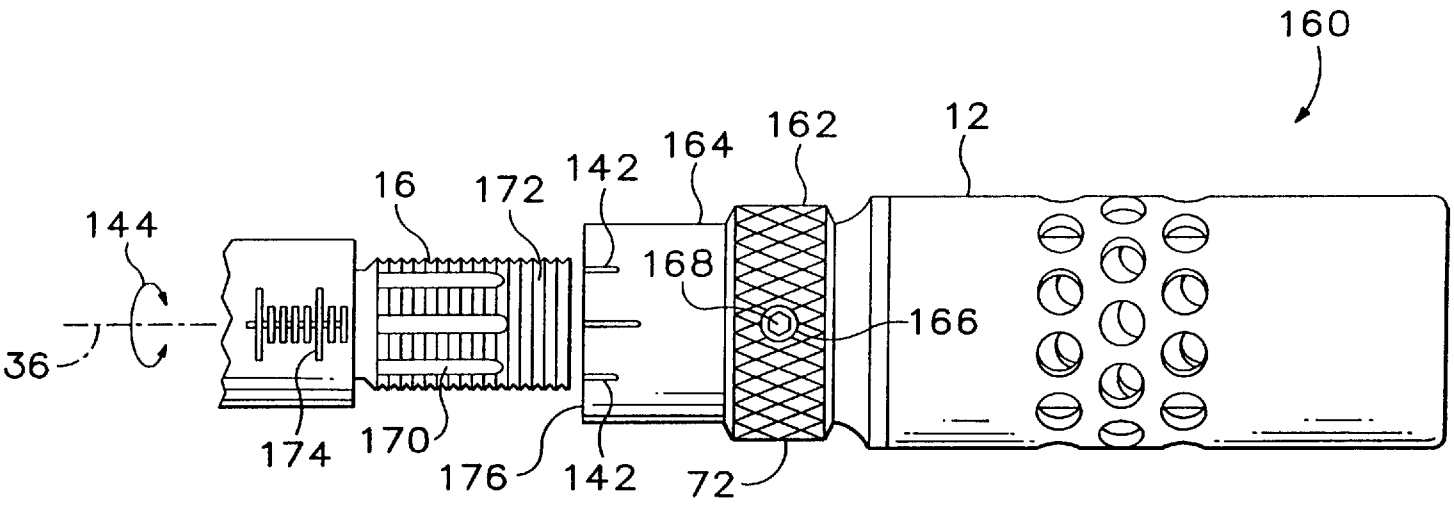
FIG. 5 is a side elevational view of another embodiment of the muzzle brake positioned adjacent the muzzle end of a firearm.

Referring now to FIG. 5, which is a side elevational view of another embodiment of the muzzle brake positioned adjacent the muzzle end of a firearm, muzzle brake 160 includes an inner sheath 162 which is adapted for being threadably secured to outer sheath 12 and threadably mounted to the muzzle end 16 of the rifle barrel. Inner sheath 162 comprises an annular adjustment region 164 extending outwardly from grasping means 72 and including indexing marks 142. Indexing marks 142 preferably are regularly spaced about the circumference of one end of the adjustment region, suitably between four and ten such marks being employed. Inner sheath 162 further comprises a set screw aperture 166 extending through grasping means 72 and being adapted for receiving therein a set screw 168.

Still referring to FIG. 5, the muzzle end 16 of the rifle barrel comprises grooves 170 positioned generally parallel to axis 36 and generally perpendicularly to threads 172. Grooves 170 are regularly spaced about the circumference of muzzle end 16, suitably between eight and twelve such grooves being employed. The muzzle end of the rifle barrel further comprises adjustment marks 174 positioned generally perpendicularly to axis 36 and adjacent to threads 172.

In use, muzzle brake 160 is attached to the rifle barrel by rotational movement of the muzzle brake about the longitudinal axis of the barrel as illustrated by arc 144, such that threads 70 (FIG. 1) are engaged with threads 172. Muzzle brake 160 is then secured in place on the rifle barrel by rotational movement of set screw 168 within aperture 166 such that the set screw extends into one of grooves 170 thereby releasably preventing further rotational movement of the muzzle brake about axis 36. The rifle is then test fired, and the accuracy observed. Next, to adjust the muzzle brake on the rifle, set screw 168 is loosened from groove 170 and muzzle brake 160 is either moved inwardly or outwardly along the rifle barrel to a small extent, as measured by movement of an end surface 176 of inner sheath 162 relative to adjustment marks 174. Upon the desired positioning of end surface 176 relative to adjustment marks 174, set screw 168 is once again tightened so as to be received within one of grooves 170. The rifle is again test fired. These operations are iteratively continued until the desired firing accuracy is obtained. In this manner, indexing marks 142 and adjustment marks 174 aid in the adjustment process by allowing definite variations in position to be accomplished.

Accordingly, there is provided a muzzle brake which effectively redirects sound waves and discharge gases exiting a firearm such that the sound waves and discharge gases are redirected toward the target and away from the shooter, thereby lessening the chance of injury to the shooter's ears.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A firearm noise redirection system comprising:

a hollow inner sheath including forward, central and rear regions, the rear region adapted for attachment to a firearm and the central region including forwardly inclined apertures therein; and a hollow outer sheath including forward, central and rear regions, the forward and rear regions, respectively, of the outer sheath being adapted for attachment to the forward and rear regions of the inner sheath, and the central region of the outer sheath including forwardly inclined apertures therein and being spaced from the central region of the inner sheath so as to define a chamber therebetween such that sound waves or discharge gases entering the hollow inner sheath are redirected forwardly as the sound waves or discharge gases pass through the apertures in the inner sheath, through the chamber, and thereafter through the apertures in the outer sheath.

2. A firearm noise redirection system according to claim 1 wherein the inner sheath defines an elongate axis and wherein the apertures of the inner sheath are forwardly inclined at an angle of between 5° and 20° from a position perpendicular to the elongate axis.

3. A firearm noise redirection system according to claim 2 wherein the angle is 11°.

4. A firearm noise redirection system according to claim 1 wherein the outer sheath defines an elongate axis and wherein the apertures of the outer sheath are forwardly inclined at an angle of between 5° and 20° from a position perpendicular to the elongate axis.

5. A firearm noise redirection system according to claim 4 wherein the angle is 11°.

6. A firearm noise redirection system according to claim 1 wherein the outer sheath is threadably attached to the inner sheath at the forward and rear regions of the inner sheath.

7. A firearm noise redirection system according to claim 1 wherein the apertures on the inner sheath are circumferentially arranged in rows.

8. A firearm noise redirection system according to claim 1 wherein the apertures on the outer sheath are circumferentially arranged in rows.

9. A firearm noise redirection system according to claim 1 wherein the apertures on the outer sheath are staggered and misaligned with respect to the apertures on the inner sheath.

10. A firearm noise redirection system comprising:

a hollow inner sheath including forward, central and rear regions, the rear region adapted for attachment to a firearm and the central region including forwardly inclined apertures therein;

a hollow outer sheath including forward, central and rear regions, the forward and rear regions, respectively, of the outer sheath being adapted for attachment to the forward and rear regions of the inner sheath, and the central region of the outer sheath including forwardly inclined apertures therein and being spaced from the central region of the inner sheath so as to define a chamber therebetween such that sound waves or discharge gases entering the hollow inner sheath are redirected forwardly as the sound waves or discharge gases pass through the apertures in the inner sheath, through the chamber, and thereafter through the apertures in the outer sheath, the firearm noise redirection system; and an adjustment element mounted adjacent the rear region of said hollow inner sheath, wherein said adjustment element provides a stop for defining the extent of rearward movement of said hollow inner sheath relative to a barrel of the firearm.

11. A firearm noise redirection system according to claim 10 wherein said adjustment element comprises an annular member in threaded engagement with the barrel of the firearm.

12. A firearm noise redirection system according to claim 11 wherein said annular member is continuously adjustable in position along an extent of the barrel of the firearm.

13. A muzzle brake for a rifle comprising:

a first chamber adapted for mounting to a barrel of the rifle and for receiving a bullet therethrough when the rifle is fired, wherein said first chamber has plural forwardly inclined first apertures defined therein, said apertures of lesser diameter than the bullet; and a second chamber in surrounding engagement with said first chamber, wherein said second chamber includes plural forwardly inclined second apertures therein, ones of said second apertures being off-alignment with ones of said first apertures.

14. A muzzle brake according to claim 13 wherein said first apertures are forwardly inclined at an angle of between 5° and 20° relative to a direction of travel of the bullet.

15. A muzzle brake according to claim 14 wherein the angle is 11°.

16. A muzzle brake according to claim 13 wherein said second apertures are forwardly inclined at an angle of between 5° and 20° relative to a direction of travel of the bullet.

17. A muzzle brake according to claim 16 wherein the angle is 11°.

18. A muzzle brake for a rifle comprising:

a first chamber adapted for mounting to a barrel of the rifle and for receiving a bullet therethrough when the rifle is fired, wherein said first chamber has plural forwardly inclined first apertures defined therein, said apertures of lesser diameter than the bullet;

a second chamber in surrounding engagement with said first chamber, wherein said second chamber includes plural forwardly inclined second apertures therein, ones of said second apertures being off-alignment with ones of said first apertures, the muzzle brake; and an adjustment element mounted with said first and second chambers, wherein said adjustment element provides a stop for defining the extent of rearward movement of said muzzle brake relative to a barrel of the rifle.

19. A muzzle brake according to claim 18 wherein said adjustment element comprises an annular member in threaded engagement with the barrel of the rifle.

20. A muzzle brake 19 wherein said annular member is continuously adjustable in position along an extent of the barrel of the rifle.

21. A firearm noise redirection system comprising:

a hollow inner sheath including forward, central and rear regions, the rear region including a securement device adapted for engagement with a firearm so as to secure the firearm noise redirection system thereto and the central region including forwardly inclined apertures therein; and a hollow outer sheath including forward, central and rear regions, the forward and rear regions, respectively, of the outer sheath being adapted for attachment to the forward and rear regions of the inner sheath, and the central region of the outer sheath including forwardly inclined apertures therein and being spaced from the central region of the inner sheath so as to define a chamber therebetween such that sound waves or discharge gases entering the hollow inner sheath are redirected forwardly as the sound waves or discharge gases pass through the apertures in the inner sheath, through the chamber, and thereafter through the apertures in the outer sheath.

22. A firearm noise redirection system according to claim 21 wherein the inner sheath defines an elongate axis and wherein the apertures of the inner sheath are forwardly inclined at an angle of between 5° and 20° from a position perpendicular to the elongate axis.

23. A firearm noise redirection system according to claim 22 wherein the angle is 11°.

24. A firearm noise redirection system according to claim 21 wherein the outer sheath defines an elongate axis and wherein the apertures of the outer sheath are forwardly inclined at an angle of between 5° and 20° from a position perpendicular to the elongate axis.

25. A firearm noise redirection system according to claim 24 wherein the angle is 11°.

26. A firearm noise redirection system according to claim 21 wherein the outer sheath is threadably attached to the inner sheath at the forward and rear regions of the inner sheath.

27. A firearm noise redirection system according to claim 21 wherein the apertures on the inner sheath are circumferentially arranged in rows.

28. A firearm noise redirection system according to claim 21 wherein the apertures on the outer sheath are circumferentially arranged in rows.

29. A firearm noise redirection system according to claim 21 wherein the apertures on the outer sheath are staggered and misaligned with respect to the apertures on the inner sheath.

30. A firearm noise redirection system comprising:

a hollow inner sheath including forward, central and rear regions, the rear region including a securement device adapted for engagement with a firearm so as to secure the firearm noise redirection system thereto and the central region including forwardly inclined apertures therein; and a hollow outer sheath including forward, central and rear regions, the forward and rear regions, respectively, of the outer sheath being adapted for attachment to the forward and rear regions of the inner sheath, and the central region of the outer sheath including forwardly inclined apertures therein and being spaced from the central region of the inner sheath so as to define a chamber therebetween such that sound waves or discharge gases entering the hollow inner sheath are redirected forwardly as the sound waves or discharge gases pass through the apertures in the inner sheath, through the chamber, and thereafter through the apertures in the outer sheath, wherein said rear region of said inner sheath further comprises an adjustment element.

31. A firearm noise redirection system according to claim 30 wherein said adjustment element comprises an annular region in threaded engagement with a barrel of the firearm.

32. A firearm noise redirection system according to claim 31 wherein said annular region is continuously adjustable in position along an extent of the barrel of the firearm.

33. A firearm noise redirection system according to claim 21 wherein said securement device comprises a securement aperture and a set screw releasably secured therein.

* * * * *